US008151743B2

(12) United States Patent
Reustle

(10) Patent No.: US 8,151,743 B2
(45) Date of Patent: Apr. 10, 2012

(54) COOLING CHANNELS IN THE CYLINDER HEAD OF AN INTERNAL COMBUSTION ENGINE

(75) Inventor: Albrecht Reustle, Walheim (DE)

(73) Assignee: Dr. Ing. h.c. F. Porsche Aktiengesellschaft, Stuttgart (DE)

( * ) Notice: Subject to any disclaimer, the term of this patent is extended or adjusted under 35 U.S.C. 154(b) by 724 days.

(21) Appl. No.: 12/147,902

(22) Filed: Jun. 27, 2008

(65) Prior Publication Data

US 2009/0000578 A1 Jan. 1, 2009

(30) Foreign Application Priority Data

Jun. 30, 2007 (DE) ..... 10 2007 030 482

(51) Int. Cl.
*F02F 1/40* (2006.01)
*F01P 3/14* (2006.01)

(52) U.S. Cl. ..... 123/41.82 R; 123/41.76; 123/41.85

(58) Field of Classification Search ..... 123/76, 123/85, 188.9, 41.82 R
See application file for complete search history.

(56) References Cited

U.S. PATENT DOCUMENTS

| | | | | | |
|---|---|---|---|---|---|
| 2,078,499 | A | * | 4/1937 | Ljungstrom | 123/41.42 |
| 3,074,389 | A | * | 1/1963 | Lilly | 123/41.73 |
| 3,353,522 | A | * | 11/1967 | Ley | 123/41.31 |
| 3,822,680 | A | * | 7/1974 | Showalter et al. | 123/41.16 |
| 4,593,655 | A | * | 6/1986 | Mezger | 123/41.77 |
| 4,676,202 | A | * | 6/1987 | Johnson | 123/41.67 |
| 5,615,641 | A | * | 4/1997 | Koch et al. | 123/41.82 R |
| 5,868,107 | A | * | 2/1999 | Betsch et al. | 123/41.82 R |
| 5,983,844 | A | | 11/1999 | Hauder | |
| 6,158,408 | A | | 12/2000 | Hauder | |
| 6,629,516 | B1 | * | 10/2003 | Minemi et al. | 123/193.5 |
| 6,681,727 | B2 | * | 1/2004 | Krenn | 123/41.82 R |
| 6,776,128 | B2 | * | 8/2004 | Baba et al. | 123/41.82 R |
| 6,810,838 | B1 | * | 11/2004 | Hellman | 123/41.28 |
| 7,063,051 | B2 | * | 6/2006 | Schellhase | 123/41.85 |
| 7,191,740 | B2 | * | 3/2007 | Baba et al. | 123/41.82 R |
| 2002/0124815 | A1 | | 9/2002 | Ishiguro et al. | |

FOREIGN PATENT DOCUMENTS

| | | | |
|---|---|---|---|
| DE | 3412052 | C2 | 10/1985 |
| DE | 4420130 | C1 | 11/1995 |
| DE | 19723342 | C1 | 9/1998 |
| DE | 19723343 | C1 | 10/1998 |
| DE | 10358116 | A1 | 7/2005 |
| EP | 0206125 | A2 | 12/1986 |
| EP | 1239135 | A2 | 9/2002 |
| EP | 1329628 | B1 | 7/2003 |

* cited by examiner

*Primary Examiner* — Noah Kamen
*Assistant Examiner* — Grant Moubry
(74) *Attorney, Agent, or Firm* — Laurence A. Greenberg; Werner H. Stemer; Ralph E. Locher

(57) ABSTRACT

In a method for casting a cylinder head of a piston engine in a region of cooling channels for valve seat rings, a separate core is provided for defining cooling channels, and the cooling channel core is mounted in a bottom plate of a casting mold at various points thereof. The cooling channels for the valve seat rings have a cooling channel region formed by two interconnected rings and at least one cooling fluid supply channel and at least one cooling fluid drain channel. The two rings are disposed at a distance from the valve seat rings, adjacent to them.

10 Claims, 4 Drawing Sheets

COOLING CHANNELS IN THE CYLINDER HEAD OF AN INTERNAL COMBUSTION ENGINE

CROSS-REFERENCE TO RELATED APPLICATION

This application claims the priority, under 35 U.S.C. §119, of German application DE 10 2007 030 482.1, filed Jun. 30, 2007; the prior application is herewith incorporated by reference in its entirety.

BACKGROUND OF THE INVENTION

1. Field of the Invention

The invention concerns a method for casting a cylinder head of a piston engine in the region of cooling channels for valve seat rings, wherein a separate core is provided for the cooling channels, and the cooling channel core is mounted in a bottom plate at various points of the bottom plate of a casting mold. Moreover, the invention concerns cooling channels for valve seat rings of a cylinder head of a piston engine, especially cooling channels made according to the invention.

A method for the casting of a cylinder head of a piston engine in the region of cooling channels for valves is known from published, European patent application EP 1 239 135 A2 (corresponding to U.S. patent publication No. 2002/0124815), wherein a separate core is provided for the cooling channels, and the cooling channel core is mounted in a bottom plate at various points of the bottom plate of a casting mold. The cooling channels produced by this method serve, in particular, for improved cooling of the cylinder head in the region of the combustion chamber. The cooling channels are also positioned in the region of two intake valves, two exhaust valves, and one fuel injection nozzle. A feed channel for cooling fluid is connected to a middle cooling channel, which is positioned next to the two exhaust valves between them and the injection nozzle. One end of the middle channel is connected to a drain channel at a crankcase end. The other end of the middle cooling channel emerges into two cooling channels, one of these cooling channels being arranged at the side of the exhaust valve arrangement away from the middle cooling channel and the other cooling channel at the side of the arrangement of the two intake valves away from the middle cooling channel. The outer cooling channels likewise communicate with the drain channels at the crankcase end. Thus, the three cooling channels form a kind of double U arrangement, where the two U-shapes share a leg in common.

The core for the casting of the cooling channels is fashioned in accordance with this arrangement of the cooling channels, so that the core has channels for the passage of the cooling fluid.

European patent EP 0 206 125 B1 describes a cylinder head of a fluid-cooled internal combustion engine, in which a valve ring channel is arranged around each intake and exhaust valve, fully enclosing the valve and emerging into a respective cooling channel.

German patent DE 34 12 052 C2, corresponding to U.S. Pat. No. 4,593,655, describes a cooling device with forced flushing for the cylinder head of an internal combustion engine, in which each valve has a valve seat ring, surrounded by an annular channel, in which a coolant circulates during the operation of the internal combustion engine. The valve seat ring forms part of the wall of the annular channel, so that the coolant comes into direct contact with the valve seat ring.

The problem with this arrangement is the sealing off of the valve seat ring from the combustion chamber and from the intake and exhaust channel.

Published, European patent EP 1 329 628 A2 describes a cylinder head with a cooling channel system for a piston engine, especially a large Diesel engine, configured as a two-stroke Diesel engine and having no intake valve. The cylinder head has cooling channels around the respective exhaust valve, one of the cooling channels being arranged concentric to the exhaust valve.

SUMMARY OF THE INVENTION

It is accordingly an object of the invention to provide a method for making cooling channels in the cylinder head of an internal combustion engine which overcome the above-mentioned disadvantages of the prior art methods and devices of this general type, which provides an economical production method for cooling channels to cool the valve seat rings in a cylinder head of a piston engine, as well as to indicate a configuration of these cooling channels ensuring an effective cooling of the seat rings of the intake and/or exhaust valves.

The invention proposes a method for the casting of a cylinder head of a piston engine in the region of cooling channels for valve seat rings. A separate core is provided for the cooling channels, and the cooling channel core is mounted in a bottom plate at various points of the bottom plate of a casting mold. A separate cylinder head water core is mounted in the bottom plate and/or the cooling channel core, such that the cooling channel core is disposed between the bottom plate and the cylinder head water core. An intake channel core and/or an exhaust channel core is mounted in the bottom plate, such that two separate core regions of the channel core pass through at least one passage in the cylinder head water core and regions of the cooling channel core, which have two rings.

Thus, the method of the invention occurs in the sequence of the mounting of the cooling channel core, the mounting of the separate cylinder head water core, and the mounting of the intake channel core and/or the exhaust channel core. What is important here is that the cooling channel core is disposed between the bottom plate and the cylinder head water core. The cooling channel core, the cylinder head water core, and the intake channel core or exhaust channel core can be made outside the casting mold and be preassembled there, for example, by gluing or screw fasteners, and then be placed together into the casting mold. Thanks to this configuration and mounting of the cooling channel core, it is possible to create cooling channels enclosing the valve seat rings and integrated in the region of the flow of cooling fluid to the crankcase. The cooling channel core is a sand core, for example, between the actual cylinder head water core and a chill mold bottom plate. In this way, it is possible to preassemble the actual cylinder head water core and the cooling channel core as sand cores outside the chill mold and install them together into the chill mold. By proper configuration of the cooling channel core, it is possible to integrate the injector borehole, through which the cooling fluid enters the cooling channels and heretofore produced by mechanical drilling, into the cast cooling channels for the valve seat rings, thus producing it by casting. This provides substantial cost potentials.

Thanks to the method of the invention, cooling channels can be made for valve seat rings, and these cooling channels are not in contact with the valve seat rings, but rather a casting wall of any desired thickness is left in place. Thus, there are no problems with sealing off between the cooling channels and the valve seat rings.

The separate core regions of the intake channel core and the exhaust channel core are now preferably mounted in valve seat projections of the bottom plate or in valve seat cores, which are mounted in the bottom plate.

The invention furthermore proposes cooling channels for valve seat rings of a cylinder head of a piston engine, especially cooling channels made according to the above-described method. The cooling channels have a cooling channel region formed by two interconnected rings, with at least one cooling fluid supply channel connected to the cooling channel region and at least one cooling fluid drain channel connected to the cooling channel region. The two rings are disposed at a distance from the valve seat rings, adjacent to them. The particular ring surrounds an intake or exhaust channel of the cylinder head.

Thus, according to the invention, the two rings surround the intake or exhaust channels of the cylinder head. The two rings surround either two exhaust valves or two intake valves. It is also conceivable to provide four rings, two rings surrounding two intake valves and two rings surrounding two exhaust valves. The cooling channels are disposed at a distance from the valve seat rings, but in any case adjacent to them. Thus, cooling fluid does not get into contact with the valve seat rings. Thanks to the close arrangement of the rings relative to the valve seat rings, an effective and homogeneous dissipation of heat from the valves and the valve seat rings is achieved, bringing about a homogeneous surface temperature in the combustion space and contributing substantially to lowering the temperature in the cylinder head.

Preferably, the cooling channels are connected to one common supply channel and several drain channels.

The flow through the cooling channels is constrained, in particular, by a supply channel known as the injector supply channel, the injector supply channel being fed from the drain side via a pressure head. High flow velocities, around 4 to 6 m/s, are adjusted in the injector supply channel. This impulse makes possible a flow into the rings. At the same time, the injector supply channel brings about an optimal cooling of the hot spots upstream from a fuel injection nozzle of the cylinder head in the direction of the exhaust valve or exhaust seat rings when the cooling channels surround the exhaust channels of the cylinder head. Thanks to this combination of injector cooling of the injection nozzle and good head dissipation in the region of the seat ring, the cylinder head is cooled optimally and homogeneously in the combustion space.

In accordance with an added feature of the invention, the cooling fluid supply channel can be brought to communicate with a supply channel for cooling fluid at a crankcase side.

In accordance with an additional feature of the invention, the two interconnected rings have a shared straight annular segment, with which the cooling fluid supply channel is connected. Each of the two interconnected rings has a respective annular segment being circular in shape. The respective annular segment has two ends connected to the shared straight annular segment.

In accordance with a further feature of the invention, the drain channel is one of a plurality of drain channels, and each of the two interconnected rings empties into one of the drain channels in a region away from the shared straight annular segment. Preferably, one of the drain channels is a drain channel situated adjacent to a spark plug or an injection nozzle.

In accordance with another feature of the invention, a respective one of the drain channels can be brought into communication with a further drainage channel for the cooling fluid at the crankcase side.

In accordance with another added feature of the invention, a further cooling channel region is formed in a region of a flow end of the straight annular segment and empties into one of the drain channels. The one of the drain channels communicates with a cooling channel of the cylinder head, and the cooling channel of the cylinder head serves for actual cooling of the cylinder head. The cooling fluid supply channel and at least one of the drain channels are in direct communication with the cooling channel for the cooling of the cylinder head.

In accordance with another further feature of the invention, the annular segments are disposed concentric to an axis of rotation of the valve seat ring facing the two interconnected rings.

In accordance with a further additional feature of the invention, the two interconnected rings surround two exhaust valve seat rings.

Other features which are considered as characteristic for the invention are set forth in the appended claims.

Although the invention is illustrated and described herein as embodied in a method for making cooling channels in the cylinder head of an internal combustion engine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
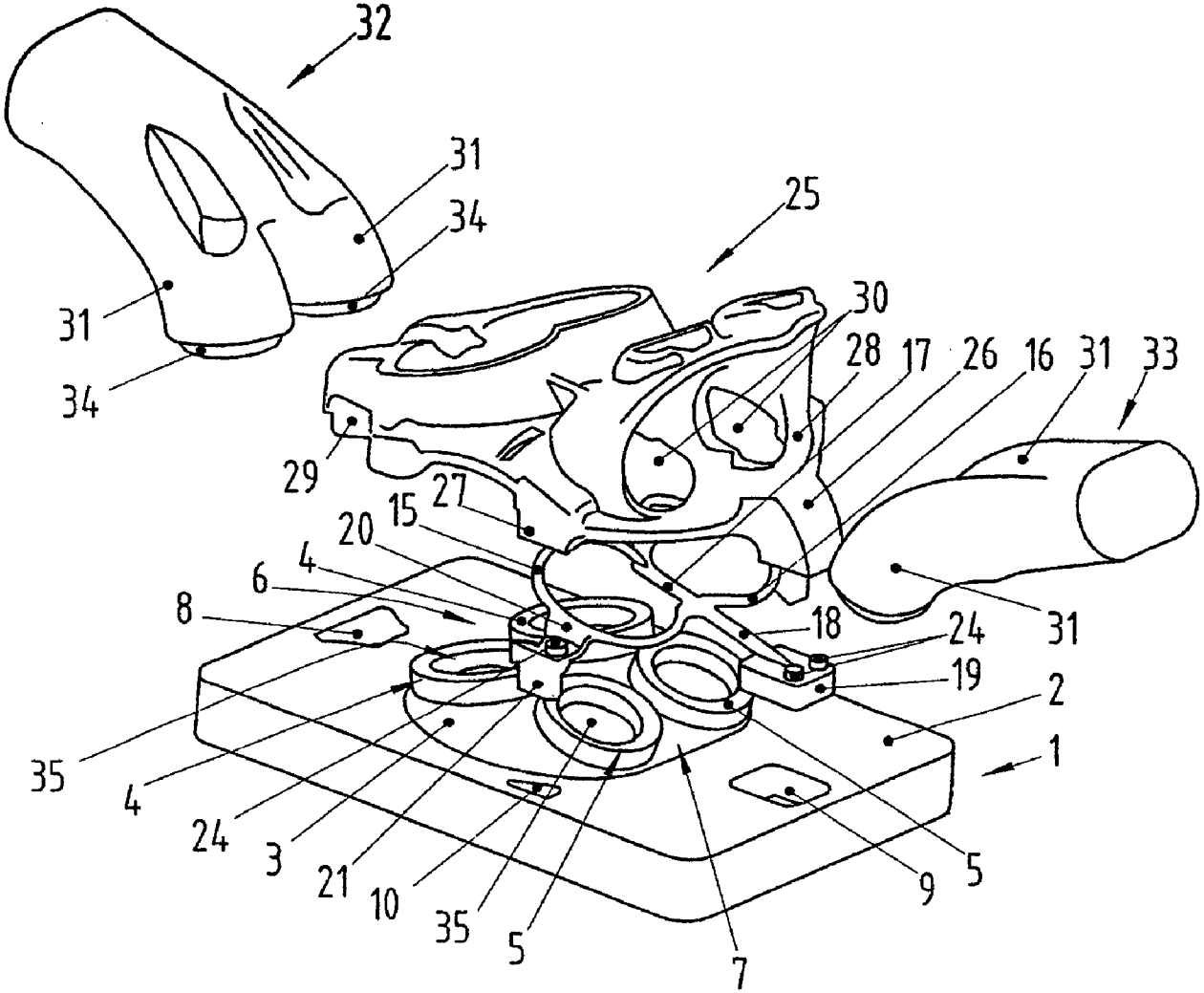
FIG. 1 is a diagrammatic, exploded perspective view of partial regions of a casting mold with a bottom plate, a cooling channel core, a cylinder head water core, an intake channel core and an exhaust channel core according to the invention.

Referring now to the figures of the drawing in detail and first, particularly, to FIG. 1 thereof, there is shown a region of a chill mold necessary to understand the invention. One notices a chill mold bottom plate 1 with level surface region 2, which after the casting process represents the flat bottom side of the cylinder head in the region of a cylinder, also with an elevated region 3 as compared to the flat surface region 2, which represents the combustion space of the cylinder when the cylinder head is finished, and finally four annular segments 4 and 5 projecting beyond the elevated region 3. The annular segments 4 and 5 form recesses in the cylinder head when it is cast and finished, serving to accommodate the valve seat rings in the final machined cylinder head. The annular segments 4 pertain to the two intake valves of the cylinder, and the annular segments 5 to the two exhaust valves of this cylinder.

The two annular segments 4 form a pair of annular segments 6, the two annular segments 5 a pair of annular segments 7. The respective annular segment pair 6 or 7 is disposed at an inclination relative to the flat surface region 2 by the respective valve angle; this inclination is dictated by the camber of the elevated region 3, and the inclination of the annular segment pairs 6 and 7 corresponds to the tilt of the valves.

The bottom plate 1 has bearing depressions 8 and 9 in the flat surface region 2, in opposite end regions of the bottom plate 1. The arrangement shown in FIG. 1 is symmetrical to a plane running perpendicular to the surface region 2 and passing through the bearing depressions 8 and 9. In the region of the other two sides of the bottom plate 1, it is provided with two bearing depressions 10 and 11 in the flat surface region 2, adjacent to the annular segment pair 7 and the elevated region 3, whose cross section, cut parallel to the flat surface region 2, is identical to but considerably smaller than the cross section of the bearing depressions 8 and 9.

Figure 2:
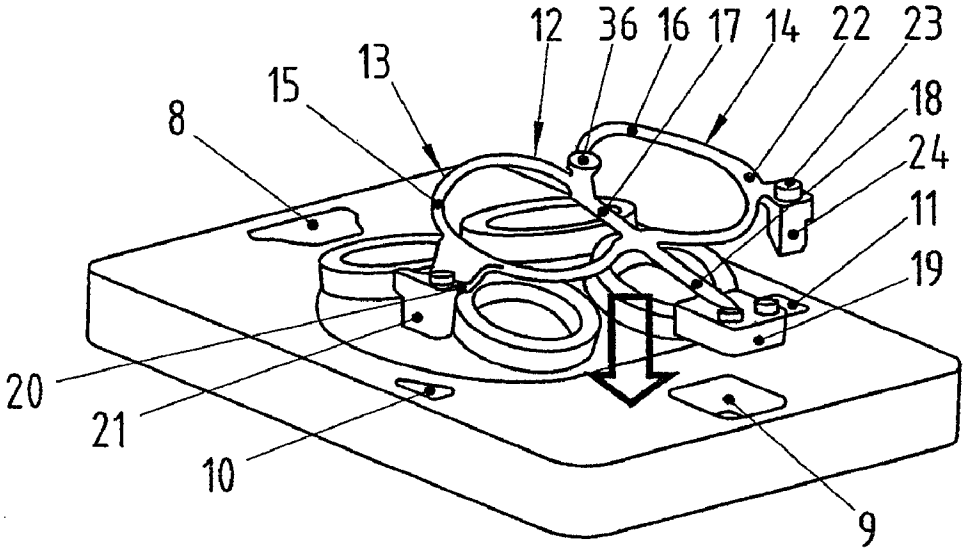
FIG. 2 is a diagrammatic, exploded perspective view of the bottom plate and the cooling channel core shown in FIG. 1.

As is especially visible in the representation of FIG. 2, the bearing depressions 9, 10 and 11 serve to bear a cooling water core 12 in the bottom plate 1. The cooling water core 12 is configured as a sand core. It has two interconnected rings 13 and 14, the ring 13 having a circular annular segment 15 and the ring 14 a circular annular segment 16 and both rings 13 and 14 possessing a common straight annular segment 17, which joins the ends of the annular segments 15 and 16.

The cooling water core 12 has a straight web 18 as a prolongation of the straight annular segment 17, whose end away from the annular segment 17 is connected to a block like bearing element 19, which is shaped complementary to the bearing depression 9. At the end away from the straight annular segment 17, the annular segment 15 is joined to a web 20, whose end away from the annular segment 15 is joined to a bearing element 21, which is shaped complementary to the bearing depression 10. Accordingly, the other annular segment 16 in its region away from the straight annular segment 17 is joined by a web 22 to a bearing element 23, which is shaped complementary to the bearing depression 11.

The bearing elements 19, 21 and 23 are provided, in their upper region, with seats 24 for inserting a separate cylinder head water core 25 onto the cooling water core 12. The cylinder head water core 25 has core projections 26, 27 and 28 for this purpose, with corresponding recesses for the seats 24. In the region of the end away from the core projection 26, the cylinder head water core 25 is provided with another core projection 29, which is provided with a cross sectional shape complementary to the bearing depression 8.

Figure 3:
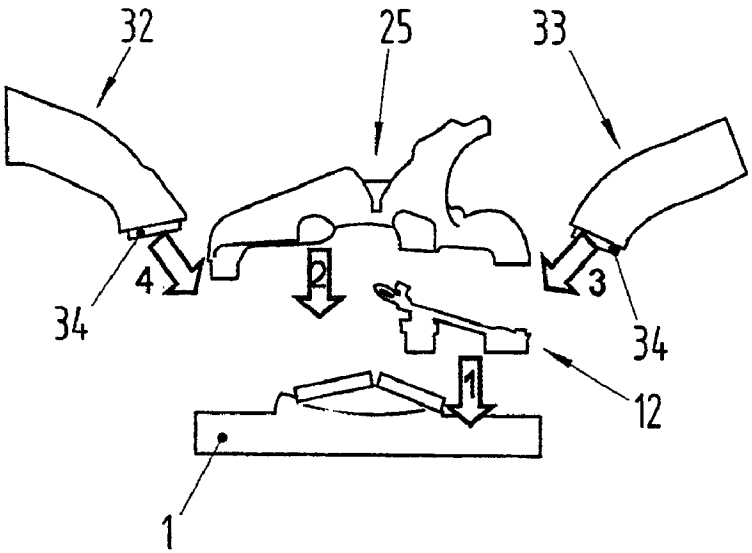
FIG. 3 is an exploded, side view of the parts shown in FIG. 1, illustrating the assembly sequence of the parts.

The assembly of cooling water core 12 and cylinder head water core 25 can take place separately or in the process of the preassembly outside of the chill mold. During the assembly, one first inserts the cooling water core 12 in the sense of the method step per arrow 1 in FIG. 3 with its bearing elements 19, 21 and 23 into the bearing depressions 9, 10, and 11 of the bottom plate 1. Next, according to the step per arrow 2 in FIG. 3, the cylinder head water core 25 is placed by its core projections 26, 27 and 28 onto the seats 24 of the bearing elements 19, 21 and 23 of the cooling water core 12, on the one hand, and on the other hand the cylinder hear water core 25 is inserted by its core projection 29 into the bearing depression 8 of the bottom plate 1. As can be seen from FIG. 4, the annular segments 15 and 16 of the cooling water core 12 enclose the annular segments 5 concentrically and the straight annular segment 17 is disposed between the two annular segments 5. Thanks to the described arrangement, the cooling water core 12 is arranged between the bottom plate 1 and the cylinder head water core 25.

Adjacent to the annular segments 4 and adjacent to the annular segments 5, the cylinder head water core 25 is provided with openings, which in the assembled condition pass through two core channels 31 of the intake channel core 32 and exhaust channel core 33. In the region of the exhaust channel core 33, two openings 30 are provided, whereby each opening 30 accommodates one core channel 31. In the region of the intake channel core 32, the cylinder head water core 25 is provided with only one opening 30 (see FIG. 5).

After the cylinder head water core 25 has been mounted, the intake channel core 32 and the exhaust channel core 33 are mounted. In the specific sample embodiment, as can be seen from FIG. 3, first the exhaust channel core is mounted per arrow 3 and then the intake channel core 32, as shown by arrow 4.

The mounting of the particular channel core 32 and 33 is done by inserting it with its core channels 31 through the opening 30 or the two openings 30, respectively, and in the region of projecting cylindrical shoulders 34 the annular segments 4 and annular segments 5 are inserted into complementary shaped recesses or core bearings 35 of the intake and exhaust channel cores.

Figure 4:
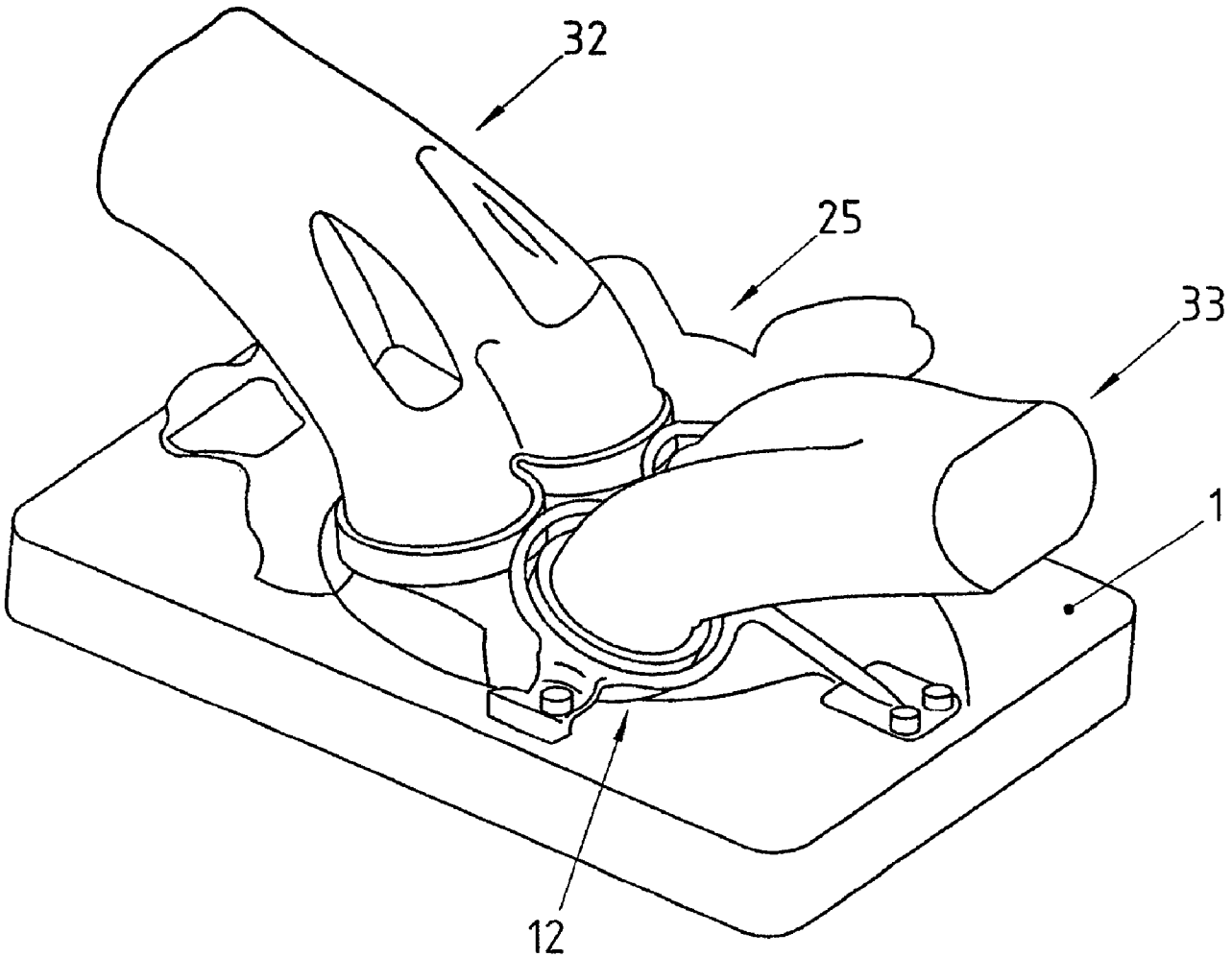
FIG. 4 is a diagrammatic, three-dimensional view of the parts shown in FIG. 1, in their assembled condition.

This final assembled arrangement of the bottom plate 1, the cooling water core 12, the cylinder head water core 25, the intake channel core 32 and the exhaust channel core 33 is illustrated in FIG. 4.

Figure 5:
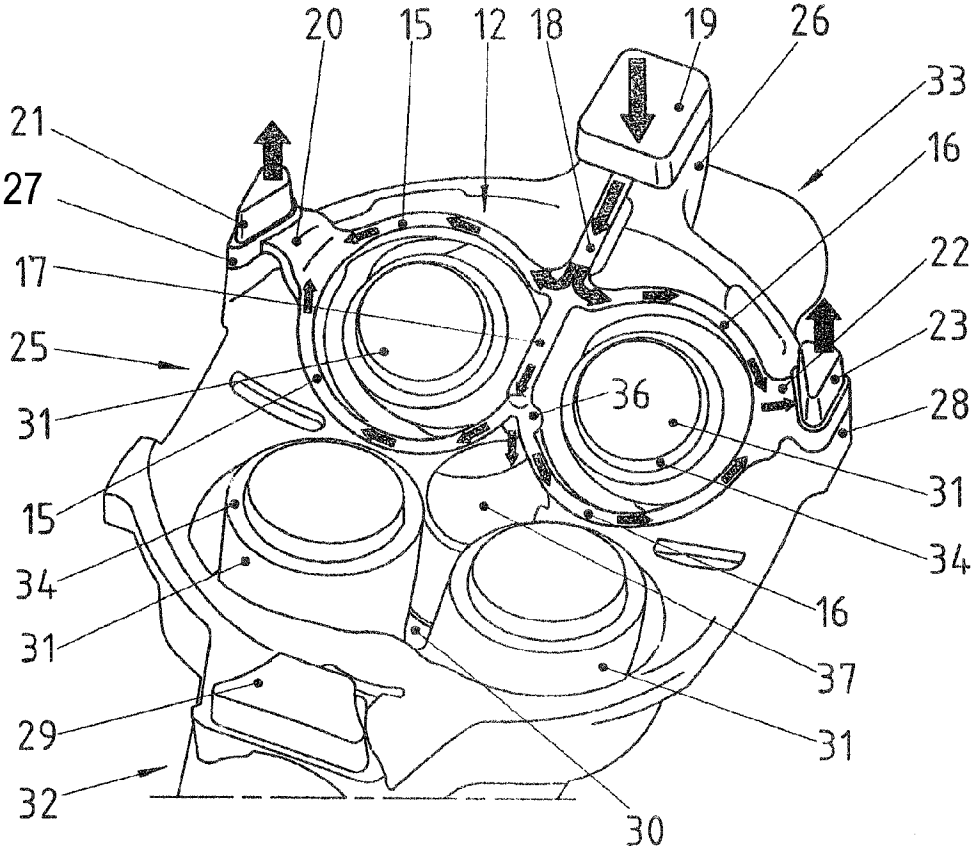
FIG. 5 is a diagrammatic, three-dimensional view from underneath of the cooling channel core, the cylinder head water core, the intake channel core and the exhaust channel core.

FIG. 5 shows the cooling water core 12, the cylinder head water core 25, as well as the intake channel core 32 and exhaust channel core 33 in a view from below. This view and also the representation of FIG. 2 show that the straight annular segment 17 has a web 36, here in the region of its end opposite the web 18, which in the assembled cylinder head water core 25 spans the gap between the annular segment 17 and the cylinder head water core 25. Moreover, FIG. 5 shows a central passage 37 in the cylinder head water core 25. The final cast cylinder head has in this region a roughly round opening, which is bored through, so that the cylinder head can accommodate a spark plug and/or an injection nozzle in this region. Thus, it is arranged adjacent to the annular segments 15 and 16.

In the cast cylinder head, the cooling channels for the valve seat rings of the cylinder head are produced according to the cooling water core 12 and the cavity to contain the cooling fluid of the actual cylinder head corresponds to the cylinder head water core 25. Hence, to describe the cooling system of the cylinder head in the relevant cylinder segment one can rely directly on the representation of the figures, especially the representation of FIG. 5, where the flow through the cooling channels for the valve seat rings is illustrated with arrows by the cooling water core 12.

One notices from FIG. 5 that the cooling fluid, starting from the cylinder head (bearing depression 9 of the bottom plate 1), goes to the injector bore (web 18 and straight annular segment 17). The cooling fluid at approximately half length of the injector bore (at the end of the web 18) enters the ring like cooling channels (annular segments 15 and 16) assigned to the two valve seat rings of the exhaust channels, while a portion of the cooling fluid continues to flow as far as the end of the injector bore (end of the straight annular segment 17) and there the cooling fluid divides among the two cooling channels (annular segments 15 and 16) and the channel (web 36) communicating with the flow of the actual cooling channel of the cylinder head. Consequently, the cooling fluid flows in the annular segments of the respective ring like cooling channel in the contrary direction, starting on the one hand from the beginning of the straight shared channel segment and on the other hand from the end of the shared straight channel segment (beginning of the straight annular segment 17 and end of the straight annular segment 17). In the region of the side of the respective annular segment opposite the injector bore, the cooling currents merge in an exit channel (web 20 and 22) and go from there to the drain channel to the crankcase (bearing depressions 10 and 11 in the bottom plate 1). In this embodiment, therefore, the cooling channels for the valve seat rings of the two exhaust valves have an inflow channel, by which the cooling fluid flows from the crankcase to the cylinder head, and moreover two outflow channels, from which the cooling fluid both from the cooling channels for the actual cooling of the cylinder head and also from the cooling channels for the valve seat rings drains away to the crankcase; finally, another flow connection is present from the injector bore to the cooling channel of the actual cooling of the cylinder head.

In the region where the cooling fluid flows into the cooling channels for the valve seat rings (bearing element 19), the cooling flow divides and a portion of the cooling fluid gets directly into the actual cooling channels for the cylinder head (core projection 26). The cooling channels for the actual cooling of the cylinder head are finally connected via a cooling channel to the crankcase (interaction of core projection 29 and bearing depression 8); through this cooling channel, cooling fluid flows out from the cylinder head.

The invention claimed is:

1. Cooling channels for valve seat rings of a cylinder head of a piston engine, the cooling channels comprising:

a cooling channel region formed by two interconnected rings;

a single cooling fluid supply channel connected to said cooling channel region;

at least two cooling fluid drain channels each fluidically connected to one of said two interconnected rings and each disposed on mutually opposite ends of different ones of the valve seat rings;

said two interconnected rings disposed at a distance from the valve seat rings, adjacent to them;

said two interconnected rings each surrounding one of an intake channel and an exhaust channel of the cylinder head; and said two interconnected rings having a shared straight annular segment directly connected to and receiving a whole quantity of a cooling fluid from said single cooling fluid supply channel, each of said two interconnected rings having a respective annular segment being circular in shape, said respective annular segment having two ends connected to said shared straight annular segment, each of said two ends of said respective annular segment connected to said shared straight annular segment and receiving and channeling an incoming flow of the cooling fluid supplied from said cooling fluid supply channel to a respective one of said cooling fluid drain channels.

2. The cooling channels for the valve seat rings according to claim 1, wherein said cooling fluid supply channel can be brought to communicate with a supply channel for cooling fluid at a crankcase side.

3. The cooling channels for the valve seat rings according to claim 1, wherein each of said two interconnected rings empties into one of said drain channels in a region away from said shared straight annular segment.

4. The cooling channels for the valve seat rings according to claim 3, wherein a respective one of said drain channels can be brought into communication with a further drainage channel for the cooling fluid at the crankcase side.

5. The cooling channels for the valve seat rings according to claim 3, further comprising a further cooling channel region formed in a region of a flow end of said straight annular segment and empties into one of said drain channels.

6. The cooling channels for the valve seat rings according to claim 5, wherein said one of said drain channels communicates with a cooling channel of the cylinder head, and the cooling channel of the cylinder head serves for actual cooling of the cylinder head.

7. The cooling channels for the valve seat rings according to claim 6, wherein said at least one cooling fluid supply channel and at least one of said drain channels are in direct communication with the cooling channel for the cooling of the cylinder head.

8. The cooling channels for the valve seat rings according to claim 1, wherein said annular segments are disposed concentric to an axis of rotation of the valve seat ring facing the two interconnected rings.

9. The cooling channels for the valve seat rings according to claim 1, wherein said two interconnected rings surround two exhaust valve seat rings.

10. The cooling channels for the valve seat rings according to claim 5, wherein said one of said drain channels is a drain channel situated adjacent to one of a spark plug and an injection nozzle.

* * * * *